US012486132B2

(12) United States Patent
Oguchi

(10) Patent No.: US 12,486,132 B2
(45) Date of Patent: Dec. 2, 2025

(54) MEDIUM DISCHARGE DEVICE, MEDIUM PROCESSING DEVICE, AND RECORDING SYSTEM

(71) Applicant: SEIKO EPSON CORPORATION, Tokyo (JP)

(72) Inventor: Takeru Oguchi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 245 days.

(21) Appl. No.: 18/298,158

(22) Filed: Apr. 10, 2023

(65) Prior Publication Data

US 2023/0322513 A1 Oct. 12, 2023

(30) Foreign Application Priority Data

Apr. 11, 2022 (JP) ..... 2022-064983

(51) Int. Cl.

| | |
|---|---|
| ***B65H 9/04*** | (2006.01) |
| ***B65H 5/36*** | (2006.01) |
| ***B65H 7/20*** | (2006.01) |
| ***B65H 29/00*** | (2006.01) |
| ***B65H 29/20*** | (2006.01) |

(52) U.S. Cl.

CPC ..... *B65H 9/04* (2013.01); *B65H 5/36* (2013.01); *B65H 7/20* (2013.01); *B65H 29/006* (2013.01); *B65H 29/20* (2013.01)

(58) Field of Classification Search

CPC .. B65H 5/36; B65H 29/70; B65H 2405/11151

See application file for complete search history.

(56) References Cited

U.S. PATENT DOCUMENTS

| | | | | |
|---|---|---|---|---|
| 11,142,425 | B2 * | 10/2021 | Uchibori | B65H 31/3027 |
| 2014/0110896 | A1 | 4/2014 | Ishikawa et al. | |
| 2020/0399085 | A1 | 12/2020 | Furumido et al. | |
| 2021/0094329 | A1 | 4/2021 | Shimada et al. | |

FOREIGN PATENT DOCUMENTS

| | | | |
|---|---|---|---|
| JP | 2001-335224 | A | 12/2001 |
| JP | 2014-084191 | A | 5/2014 |
| JP | 2021-001042 | A | 1/2021 |
| JP | 2021-054593 | A | 4/2021 |

* cited by examiner

*Primary Examiner* — Howard J Sanders

(74) *Attorney, Agent, or Firm* — WORKMAN NYDEGGER

(57) ABSTRACT

A medium discharge device includes an intermediate tray on which the medium aligned by the alignment section is placed, a pair of medium support sections configured to support a front end of the medium placed on the intermediate tray, and configured to be openable and closable, a discharge section for discharging a medium from the intermediate tray to the medium support section, and a curve imparting section that imparts a curve that warps in the medium direction to the medium by coming into contact with the medium discharged by the discharge unit. A step is formed between the intermediate tray and the pair of medium support sections.

13 Claims, 12 Drawing Sheets

MEDIUM DISCHARGE DEVICE, MEDIUM PROCESSING DEVICE, AND RECORDING SYSTEM

The present application is based on, and claims priority from JP Application Serial Number 2022-064983, filed Apr. 11, 2022, the disclosure of which is hereby incorporated by reference herein in its entirety.

BACKGROUND

1. Technical Field

The present disclosure relates to a medium discharge device for discharging a medium and a medium processing device provided with the medium discharge device. The present disclosure also relates to a recording system including the medium processing device.

2. Related Art

A medium processing device that performs post process such as stapling or punching on a medium such as a sheet is known in the related art, and an example thereof is shown in JP-A-2021-054593.

The medium processing device described in JP-A-2021-054593 includes a medium loading section on which the medium to be processed is placed, a pair of medium support sections that support the front end portion of the medium protruding in a discharge direction from the medium stacking section, and a loading section that is provided below the medium support sections and on which the medium dropped from the medium support sections is stacked. In this medium processing device, when processing is performed on the medium, the medium is discharged to the pair of medium support sections by a discharge roller positioned at the downstream end in the discharge direction with respect to the medium stacking section. When the medium is discharged to the pair of medium support sections and is supported by the pair of medium support sections, the pair of medium support sections opens, and the medium drops from the pair of medium support sections to the stacking section, and the medium is stacked on the stacking section.

A step, in the height direction, is formed between the medium stacking section and the pair of medium support sections described in JP-A-2021-054593, and deflection forms in the medium so as to curve in the discharge direction as in FIGS. 4, 5, and 6 of JP-A-2021-054593. When the medium in which such deflection forms is discharged from the medium stacking section to the medium support section, there is a concern that the medium rear end tends to move to return to the upstream side in the discharge direction due to an action of trying to eliminate the deflection, and thus the medium does not appropriately fall to the stacking section. If the medium does not appropriately drop to the stacking section, the degree of alignment of the medium on the stacking section deteriorates.

SUMMARY

In order to achieve the above object, a medium discharge device includes an intermediate tray having an alignment section that aligns a rear end of a medium and on which the medium aligned by the alignment section is placed, a pair of medium support sections face each other in a width direction intersecting with a discharge direction when a medium is discharged from an intermediate tray, configured to support a front end in the discharge direction of the medium placed on the intermediate tray, and configured to be openable and closable by moving in opposite directions to each other in the width direction, a discharge section for discharging a medium from the intermediate tray to the medium support section; a stacking section provided below the pair of medium support sections and on which the medium dropped from the pair of medium support sections is stacked, and a curve imparting section that by contacting the medium discharged by the discharge unit, applies a curve to the medium, wherein an upstream end of the pair of medium support sections in the discharge direction is provided lower than a downstream end of the intermediate tray in the discharge direction and the curve imparting section imparts, to the medium, a curve that warps in the medium width direction.

Further, a medium processing device has the medium discharge device, and a processing section that performs a process on a medium placed on the intermediate tray.

Further, the recording system, according to this disclosure, has a recording device having a recording unit configured to perform recording on a medium, and a medium processing device, wherein post process is performed on a medium recorded by the recording device.

DESCRIPTION OF EMBODIMENTS

Figure 1:
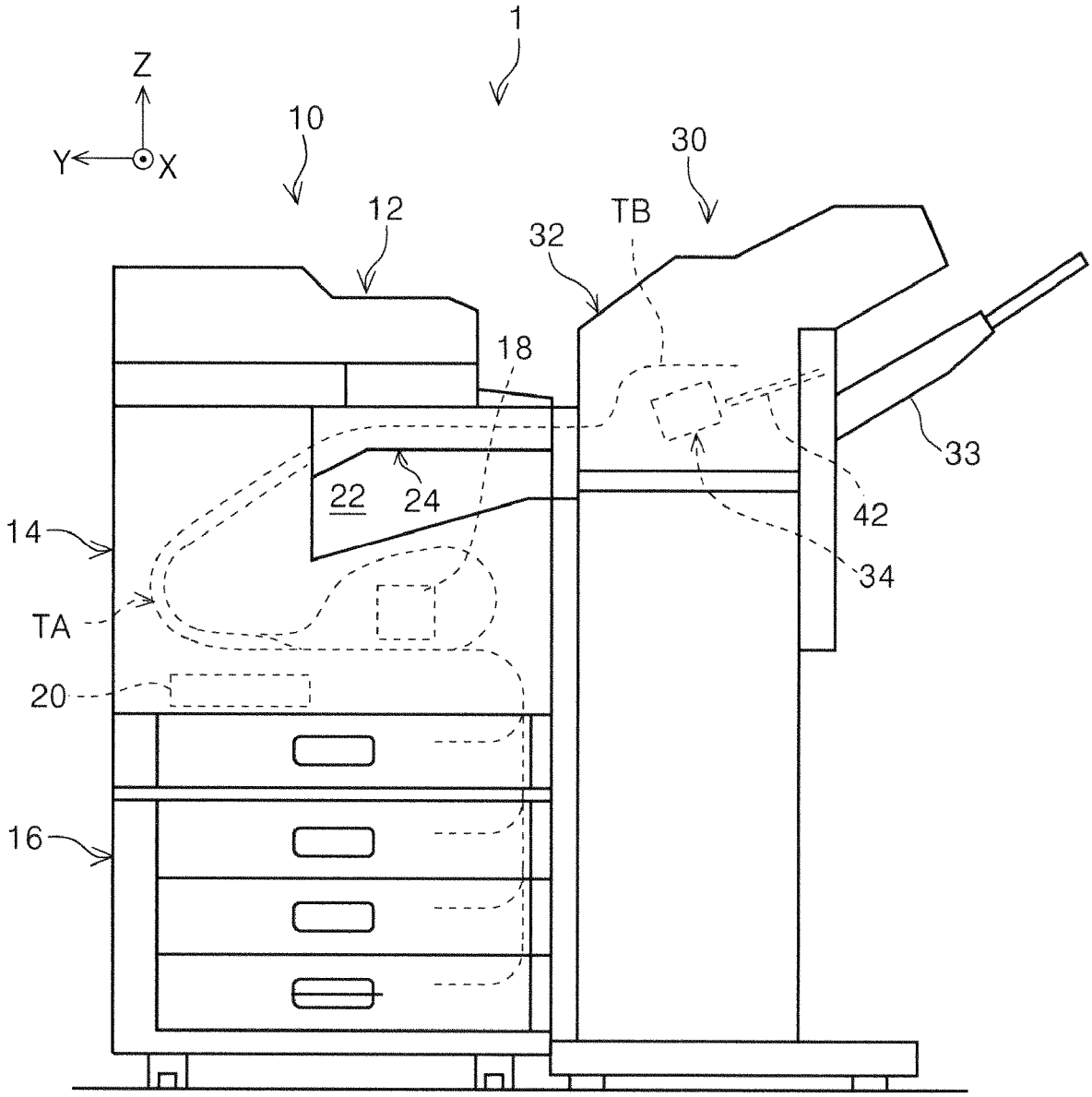
FIG. 1 is a front view of a recording system.

The following is a schematic description of this disclosure.

A medium discharge device according to a first aspect includes an intermediate tray having an alignment section that aligns a rear end of a medium and on which the medium aligned by the alignment section is placed, a pair of medium support sections face each other in a width direction intersecting with a discharge direction when a medium is discharged from an intermediate tray, configured to support a front end in the discharge direction of the medium placed on the intermediate tray, and configured to be openable and closable by moving in opposite directions to each other in the width direction, a discharge section for discharging a medium from the intermediate tray to the medium support section; a stacking section provided below the pair of medium support sections and on which the medium dropped from the pair of medium support sections is stacked, and a curve imparting section that by contacting the medium discharged by the discharge unit, applies a curve to the medium, wherein an upstream end of the pair of medium support sections in the discharge direction is provided lower than a downstream end of the intermediate tray in the discharge direction and the curve imparting section imparts, to the medium, a curve that warps in the medium width direction.

In configuration in which the upstream ends of the pair of medium support sections, in the discharge direction, are arranged so as to be lower than the downstream ends of the intermediate tray in the discharge direction, it is easy for curved deflection to occur in the medium in the discharge direction, and when the medium is discharged from the intermediate tray, the rear end of the medium tends to return upstream in the discharge direction due to the action of eliminating the deflection, so that the medium may not fall appropriately to the stacking section. However, according to this aspect, since the curve imparting section that imparts the curve that warps in the width direction to the medium by coming into contact with the medium discharged by the discharge portion is provided, it is possible to increase the rigidity of the medium in the discharge direction. Accordingly, it is possible to suppress the above-described curve of the medium in the discharge direction, and it is possible to appropriately drop the medium onto the stacking section. As a result, it is possible to suppress a decrease in the degree of alignment of the medium on the stacking section.

A second aspect is an aspect according to the first aspect, wherein the discharge section includes a discharge roller pair that nips and discharges the medium, the discharge roller pair includes a driven roller configured to contact the medium from above the medium supported by the intermediate tray and a drive roller configured to contact the medium from below the medium supported by the intermediate tray, and the curve imparting section is configured to contact the medium from above the medium supported by the intermediate tray.

According to this aspect, since the curve imparting section is configured to contact the medium from above, the medium supported by the intermediate tray, the curve imparting section acts so as to press the medium against the drive roller, the discharge action of the medium by the drive roller can be enhanced, and the medium can be appropriately discharged.

A third aspect is an aspect according to the second aspect, wherein the curve imparting section is configured to contact the medium downstream in the discharge direction from a nip position of the discharge roller pair.

According to this aspect, since the curve imparting section can come into contact with the medium downstream of the nip position of the discharge roller pair in the discharge direction, it is possible to obtain the discharge action of the medium by the drive roller for a longer period of time, and to more appropriately discharge the medium.

A fourth aspect is an aspect according to the second aspect, wherein the curve imparting section is configured by a rib.

According to this aspect, since the curve imparting section is formed of a rib, the curve imparting section can be realized with a simple structure.

A fifth aspect is an aspect according to the fourth aspect, wherein the rib includes, at a position in contact with the medium, a driven rotation section configured to rotate in contact with the medium.

According to this aspect, since the rib includes the driven rotation section that rotates in contact with the medium at a position at which the rib contacts the medium, a frictional force between the rib and the medium can be suppressed and the medium can be smoothly discharged.

A sixth aspect is an aspect according to the fourth aspect, wherein the rib is provided by utilizing the shaft of the driven roller.

According to this aspect, since the rib is provided by using the shaft of the driven roller, it is not necessary to newly add a member for providing the rib, and thus it is possible to suppress an increase in cost, and it is possible to improve the positional accuracy of the rib with respect to the discharge roller pair by attaching the rib at a position close to the discharge roller pair.

A seventh aspect is an aspect according to the second aspect, wherein the curve imparting section includes a rotating body that rotates integrally with the driven roller.

According to this aspect, since the curve imparting section is configured by a rotating body that rotates integrally with the driven roller, a frictional force between the curve imparting section and the medium is suppressed, and it is possible to smoothly discharge the medium.

An eighth aspect is an aspect according to the second aspect, wherein the discharge roller pairs are provided on both sides across the center position of the medium in the width direction, and the curve imparting section is provided to the inside of the discharge roller pairs provided on both sides across the center position in the width direction.

According to this aspect, since the curve imparting section is provided to the inside of the discharge roller pair provided on both sides with the center position interposed therebetween in the width direction, the curve imparting section can reliably impart the curve that warps in the width direction to the medium.

A ninth aspect is an aspect according to the first aspect, wherein the curve imparting section is configured to displace between a contact position where the curve imparting section can contact the medium and a separated position where the curve imparting section does not contact the medium, when the discharge section discharges the medium, the curve imparting section is located at the contact position and when the discharge portion does not discharge the medium, the discharge portion is positioned at the separation position.

In this aspect, since the curve imparting section is positioned at the separated position in a case in which the discharge section does not discharge the medium, it is possible to suppress the curve imparting section from coming into contact with the medium in a state in which the discharge section does not discharge the medium. As the result, it is possible to suppress the medium from being caught by the curve imparting section when the medium is sent to the intermediate tray or when the medium is aligned on the intermediate tray.

A tenth aspect is an aspect according to the first aspect, further including a guide member configured to switch between a guide state for guiding the medium to the alignment unit and a retracted state farther away from the intermediate tray than in the guide state, wherein the curve imparting section is provided so as to engage with the guide member, when the guide member is in the retracted state, the curve imparting section is in a first state, and when the guide member is in the guide state, the curve imparting section is in a second state in which the curve imparting section is more retracted from the intermediate tray than in the first state.

According to this aspect, the curve imparting section is provided so as to be engaged with the guide member. When the guide member is in the retracted state, the curve imparting section is in a first state. When the guide member is in the guide state, the curve imparting section is in a second state in which the curve imparting section is more retracted from the intermediate tray than in the first state. Therefore, it is possible to suppress the medium from being caught by the curve imparting section when aligning the medium on the intermediate tray.

An eleventh aspect is an aspect according to the tenth aspect, further including a passageway member that forms a discharge path at the time when a medium is discharged from the intermediate tray to the pair of medium support sections, wherein the guide member and the curve imparting section are provided to be integrally advanceable and retractable with respect to the intermediate tray and the passageway member includes a portion for avoiding interference with the guide member and the curve imparting section when the guide member and the curve imparting section advance and retract with respect to the intermediate tray.

According to this aspect, since the guide member and the curve imparting section are provided so as to be able to advance and retreat with respect to the intermediate tray, it is possible to remove a jammed medium when the medium jam on the intermediate tray by retracting the guide member and the curve imparting section from the intermediate tray. Since the passageway member includes a portion that avoids interference with the guide member and the curve imparting section when the guide member and the curve imparting section move forward and backward with respect to the intermediate tray, the guide member and the curve imparting section can appropriately retract from the intermediate tray.

A medium processing device according to a twelfth aspect includes the medium discharge device according to any one of the first to eleventh aspects and a processing section configured to perform a process on a medium placed on the intermediate tray.

According to this aspect, in the medium processing device, the effects of any one of the first to eleventh aspects described above can be obtained.

A recording system according to a thirteenth aspect includes a recording device having a recording unit configured to perform recording on a medium and the medium processing device, according to the twelfth aspect, that performs the post process on the medium recorded on by the recording device.

According to this aspect, the effects of the twelfth aspect described above can be obtained in the recording system.

A fourteenth aspect is an aspect according to the thirteenth aspect, wherein the recording section performs recording by ejecting liquid onto a medium.

In a case where recording is performed by discharging liquid onto a medium, the rigidity of the medium is likely to be weak, and the above-described problem, that is, a problem in which the medium does not appropriately fall onto the stacking section due to deflection occurring in the medium, is likely to occur. However, due to the operation and effect of the first aspect described above, it is possible to appropriately cause the medium to fall onto the stacking section even in a case where recording is performed by discharging liquid onto the medium.

Hereinafter, the present disclosure will be specifically described.

A medium discharge device 40, a post process device 30, and a recording system 1 according to an embodiment of the present invention will be described below.

In each drawing, the X-axis direction is the apparatus depth direction of the recording system 1. In the X-axis direction, a +X direction, which is the direction in which the arrow faces, is a direction from the apparatus rear surface toward the apparatus front surface, and a −X direction is a direction from the apparatus front surface toward the apparatus rear surface. The X-axis direction is an example of the width direction of the medium. The Y-axis direction is the apparatus width direction of the recording system 1 and of the Y-axis direction, the +Y direction, which is the direction in which the arrow faces, is the leftward direction as viewed from a user facing the front surface of the apparatus, and the −Y direction is the rightward direction.

The Z-axis direction is an apparatus height direction of the recording system 1 and is a vertical direction, a +Z direction in which an arrow is directed is a vertically upward direction, and a −Z direction is a vertically downward direction. In the following description, the +Z direction may be simply referred to as upward, and the −Z direction may be simply referred to as downward.

As shown in FIG. 1, the recording system 1 includes a recording device 10 and the post process device 30. The recording device 10 according to the present embodiment is an inkjet printer that performs recording by ejecting ink, which is an example of a liquid, onto a medium, which is represented by recording paper, and includes a line head 18, which is an example of a recording section. The recording device 10 is a so-called multifunction copier including a scanner unit 12 at the upper section of the apparatus.

However, the recording device 10 is not limited to an inkjet printer, and may be a device that performs recording by another method such as a laser printer, a thermal transfer printer, or a dot impact printer.

Figure 2:
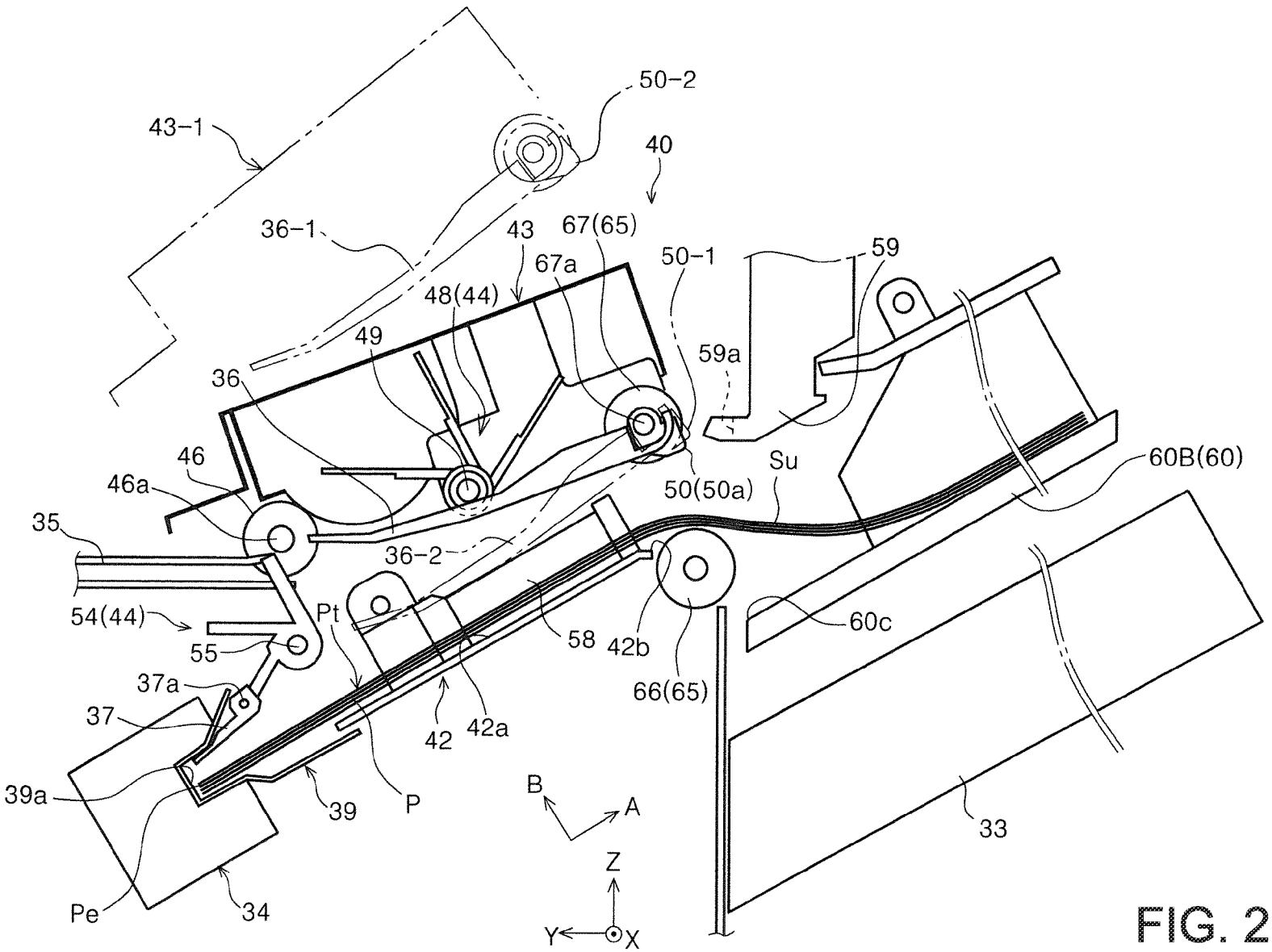
FIG. 2 is a view of internal configuration of the post process device, and shows a state in which a discharge driven roller is retracted from a discharge driving roller.
Figure 3:
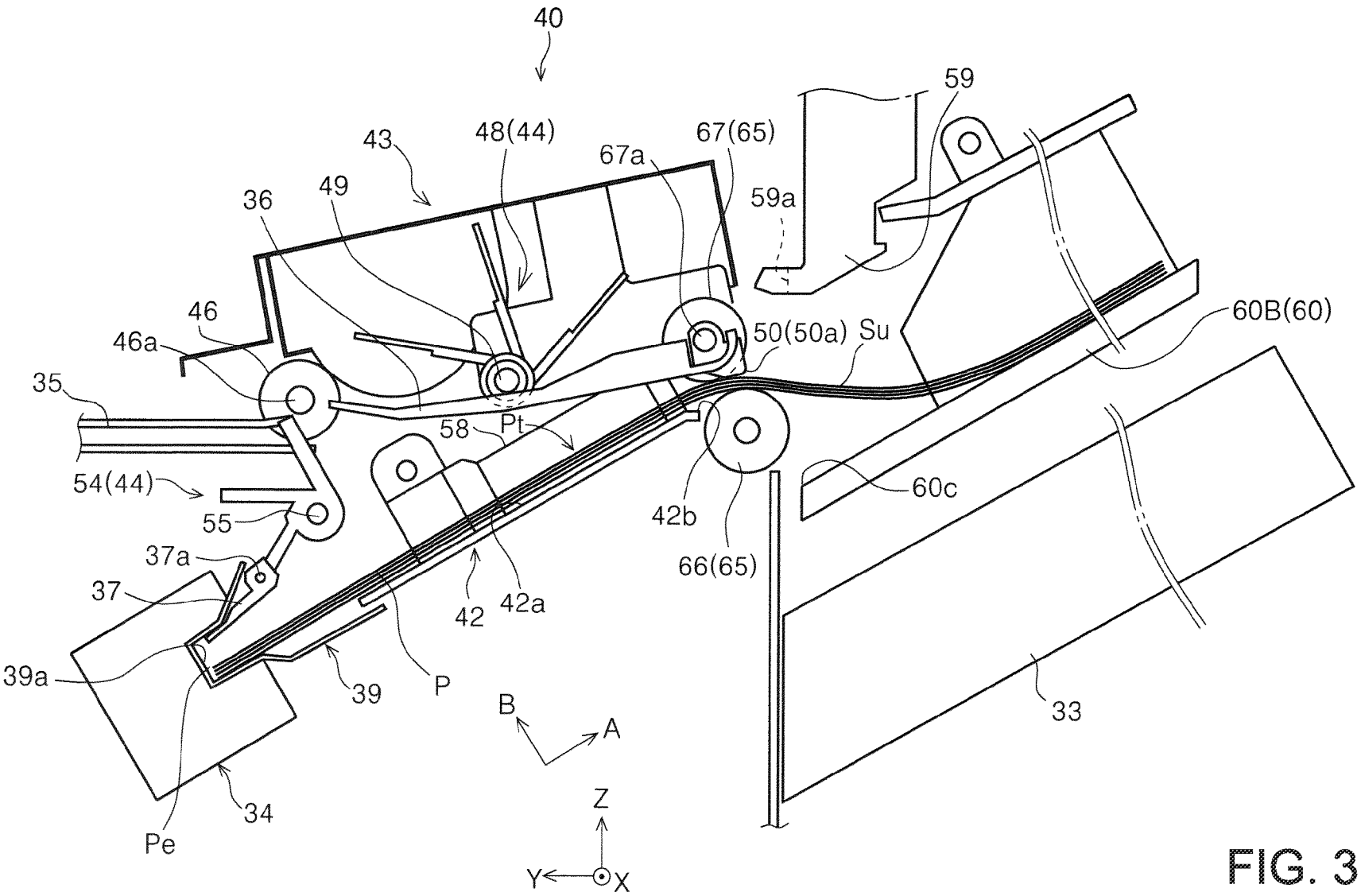
FIG. 3 is a view of internal configuration of the post process device, and shows a state in which a discharge driven roller advances to a discharge driving roller.

The recording device 10 includes a main body section 14, a medium accommodation section 16 that accommodates the medium, a medium transport unit (not illustrated) that transports the medium, the line head 18 that performs recording on the medium, an intra chassis discharge section 22 that discharges the medium, a relay unit 24 that transports the medium to the post process device 30, and a controller 20 that controls the recording device 10, the post process device 30, and the medium discharge device 40 (see FIGS. 2 and 3). A transport path TA through which the medium is transported is provided inside the main body section 14.

In the present embodiment, the controller 20 is provided in the recording device 10, but may be provided in the post process device 30 or the medium discharge device 40, which will be described later.

The line head 18 has a plurality of ink ejection nozzles (not shown) arranged corresponding to the entire area of the medium in the X-axis direction. The line head 18 performs recording on the medium by ejecting ink, supplied from an ink tank (not shown), from the ink ejection nozzles toward the medium. The controller 20 includes a CPU and a storage unit (not illustrated). The storage section of the controller 20 stores various programs and parameters for controlling the recording device 10, the medium discharge device 40 described later, the post process device 30, and the like.

The medium on which recording was performed by the recording device 10 is sent to the post process device 30 via the relay unit 24. The post process device 30 includes a device main body 32, a process tray 42 provided inside the device main body 32, a stapler 34 as an example of a post process section, the medium discharge device 40 (see FIG. 2) that discharges a medium on which a post process was performed to a lower support tray 60 (see FIG. 2), and a main tray 33 provided outside the device main body 32. The process tray 42 is an example of an intermediate tray.

The medium delivered from the relay unit 24 to the device main body 32 is transported along the transport path TB inside the device main body 32 and is sent to the process tray 42.

Referring to FIGS. 2 and 3, the configuration of the post process device 30, which is an example of the medium processing device, will be further described. Hereinafter, the medium will be appended with the reference symbol P and referred to as medium P. A medium bundle including a plurality of sheets of the medium P is appended with the reference symbol Pt and referred to as a medium bundle Pt.

A direction along the support surface 42*a* of the process tray 42 is defined as an A-axis direction, and a +A direction in the A-axis is a discharge direction in which the medium bundle Pt is discharged from the process tray 42. Hereinafter, the +A direction may be simply referred to as a discharge direction. In the present embodiment, the +A direction is a direction including a +Z direction component and a −Y direction component. In addition, a −A direction is a direction in which the medium P on the process tray 42 is pulled back toward a rear end alignment section 39.

A direction orthogonal to the A-axis direction as viewed from the X-axis direction is referred to as a B-axis direction.

A guiding member 35 constitutes a part of the transport path TB and extends toward the process tray 42. The medium P that is transported in the −Y direction along the guiding member 35 is fed toward the process tray 42 by a transport roller 46 driven by a motor (not shown). Reference numeral 46*a* denotes a rotation shaft of the transport roller 46.

The medium P sent to the process tray 42 is pulled back in the −A direction toward the rear end alignment section 39 by a pullback section 44. The pullback section 44 includes a first paddle 48 and a second paddle 54.

The first paddle 48 is made of an elastic material such as a rubber material and is provided so as to be rotatable about a rotation shaft 49, which extends in the X-axis direction. The first paddle 48 is driven in the clockwise direction of FIG. 2 by a motor (not shown), thereby applying a feeding force in the −A direction to the medium P that was fed to the process tray 42.

Similarly to the first paddle 48, the second paddle 54 is also made of an elastic material such as the rubber material and is provided so as to be rotatable about a rotation shaft 55, which extends in the X-axis direction. The second paddle 54 is driven in the clockwise direction of FIG. 2 by a motor (not shown), thereby applying a feeding force in the −A direction to the medium P that was fed to the process tray 42.

The rear end alignment section 39 is provided in the −A direction with respect to the process tray 42. The rear end alignment section 39 has an alignment surface 39*a* parallel to the B-axis direction, and the rear edge Pe of the medium bundle Pt is aligned when the rear edge of the medium P on the process tray 42 abuts against the alignment surface 39*a*.

The tip of the medium bundle Pt having a size larger than the dimension of the process tray 42 in the discharge direction protrudes from the process tray 42 in the +A direction, and the protruding tip is supported by the lower support tray 60.

Side cursors 58 are provided so as to be movable in the X-axis direction by a drive source (not shown), and align the X-axis direction edges of the medium bundle Pt supported by the process tray 42 by coming into contact with edges. Note that the side cursors 58 are arranged at an interval along the X-axis direction, and the two side cursors 58 are provided so as to approach or separate from each other. In FIGS. 2 and 3, the side cursor 58 provided in the −X direction out of the two side cursors 58 is shown.

A flap 37 is disposed side by side with the rear end alignment section 39 along the X-axis direction, and is provided so as to be swingable about a shaft section 37*a*, which extends in the X-axis direction. The flap 37 presses downward on the medium bundle Pt on the process tray 42 in the vicinity of the rear end alignment section 39.

A guide member 36 is provided so as to be swingable about a shaft 67*a* of a discharge driven roller 67, which is a shaft extending in the X-axis direction and will be described later and switches, by obtaining power of a motor (not shown) and swinging, between a guide state in which the medium P is guided to the rear end alignment section 39 and a retracted state in which the medium P is more separated from the process tray 42 than in the guide state. In FIG. 2, the guide member 36 indicated by solid line shows the guide member 36 in the retracted state, and the guide member 36 indicated by two dot chain line and a reference numeral 36-2 shows the guide member 36 in the guide state. Switching between the guide state and the retracted state of the guide member 36 is performed in a state in which a discharge driven roller 67 (to be described later) is separated from a discharge drive roller 66, as illustrated in FIG. 2, that is, in a state in which a discharge roller pair 65 does not discharge the medium bundle Pt. The discharge roller pair 65 will be described later.

When the guide member 36 is switched from the retracted state to the guide state, the medium P fed toward the process tray 42 by the transport roller 46 is tapped down toward the process tray 42. In addition, the guide member 36 guides the medium P, which is sent toward the rear end alignment section 39 on the process tray 42, to the rear end alignment section 39. As a result, the rear edge of the medium P fed toward the process tray 42 appropriately abuts against the rear end alignment section 39.

The discharge roller pair 65, as an example of a discharge section that discharges the medium bundle Pt supported by the process tray 42 in the +A direction, is provided in the +A direction with respect to the process tray 42. The discharge roller pair 65 includes the discharge driven roller 67, which can come into contact with the medium bundle Pt from above the medium bundle Pt supported by the process tray 42, and the discharge drive roller 66, which can come into contact with the medium bundle Pt from below the medium bundle Pt supported by the process tray 42. The discharge drive roller 66 is driven by a motor (not illustrated), and the discharge driven roller 67 is driven to rotate in contact with the medium bundle Pt.

The discharge driven roller 67 is provided in a movable unit 43 together with the guide member 36. The movable unit 43 is provided so as to be capable of rotating about a rotation shaft 46*a* of the transport roller 46, and switches, by rotating, between a state in which the discharge driven roller 67 advances to the discharge drive roller 66 and is in contact with the medium bundle Pt as shown in FIG. 3 and a state in which the discharge driven roller 67 is separated from the medium bundle Pt as shown in FIG. 2. That is, the discharge driven roller 67 is provided so as to be able to advance toward and retreat from the discharge drive roller 66.

The discharge driven roller 67 is separated from the discharge drive roller 66 except when the medium bundle Pt is to be discharged from the process tray 42. When the medium bundle Pt is to be discharged from the process tray 42, the discharge driven roller 67 is in contact with the medium bundle Pt and nips the medium bundle Pt with the discharge drive roller 66.

The discharge roller pair 65 discharges the medium bundle Pt, which is supported by the process tray 42 and has been subjected to the binding process by the stapler 34, toward the lower support tray 60. In the present embodiment, the post process is the binding process by the stapler 34, but the post process is not limited thereto, and may be a punching process for forming holes in the medium bundle Pt, a saddle stitching process for binding the medium bundle Pt, a shift discharge process for discharging the medium bundle Pt by alternately shifting the discharge position of the medium bundle Pt in the medium width direction, or the like. In addition, the medium bundle Pt may be discharged without performing a post process, and the medium bundle Pt may be stacked on the main tray 33 in a so-called free stacking.

Figure 4A:
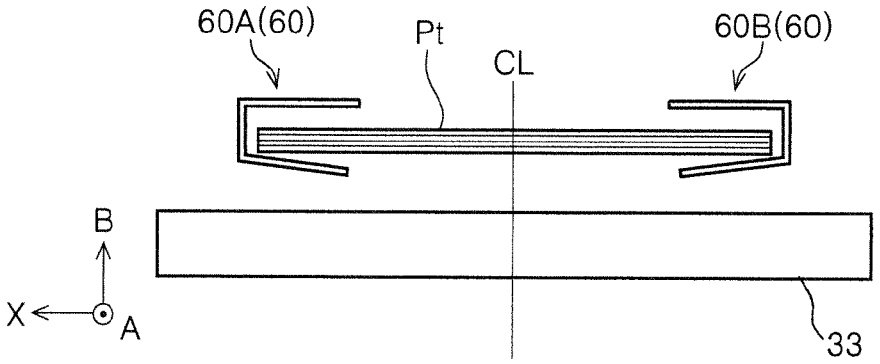
FIGS. 4A, 4B, and 4C are views of the medium discharge device as seen from the discharge direction, and are views showing the transition of the motion of the lower support tray.
Figure 4B:
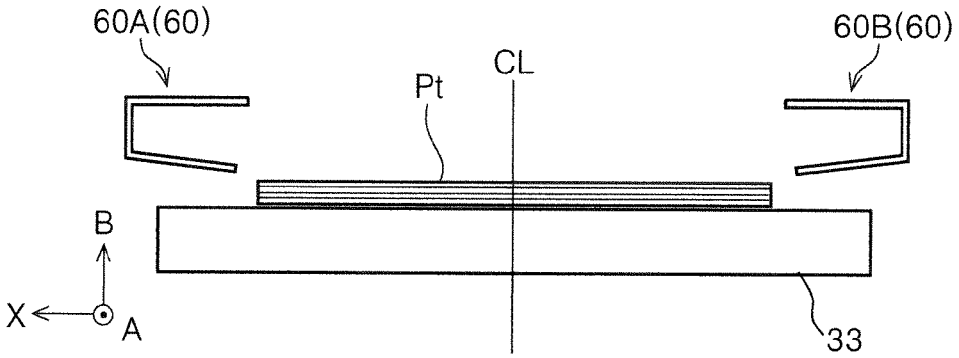
Figure 4C:
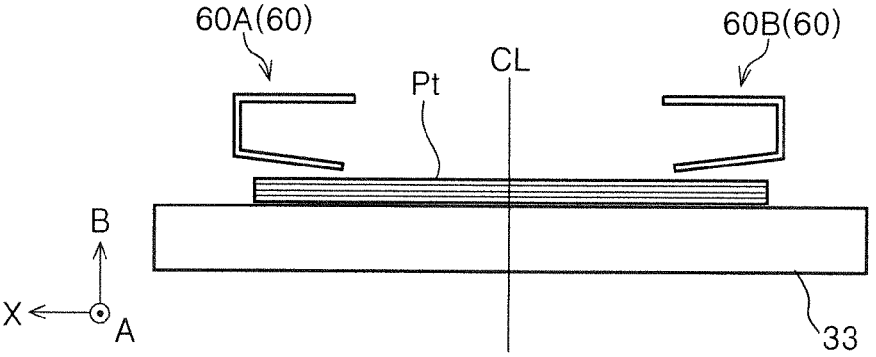

As shown in FIGS. 4A, 4B, and 4C, the lower support tray 60 includes a first moving tray 60A and a second moving tray 60B spaced apart from each other in the X-axis direction, that is, in the medium width direction. The lower support tray 60, that is, the first moving tray 60A and the second moving tray 60B are an example of a pair of medium support section. The first moving tray 60A is positioned in the +X direction with respect to the medium bundle Pt, and the second moving tray 60B is positioned in the −X direction with respect to the medium bundle Pt. Both the first moving tray 60A and the second moving tray 60B are shaped so as to sandwich, in the B-axis direction, the end section of the medium bundle Pt in the X-axis direction.

The first moving tray 60A and the second moving tray 60B are driven in the X-axis direction by a motor (not shown).

As shown in FIGS. 4A to 4C, the lower support tray 60 opens and closes as the first moving tray 60A and the second moving tray 60B move in opposite directions. To be specific, the lower support tray 60 opens up when the first moving tray 60A and the second moving tray 60B separate from each other, and closes when the first moving tray 60A and the second moving tray 60B approach each other. In FIGS. 4A to 4C, a straight line CL is a straight line parallel to the B-axis direction and passes through the center position in the width direction of the medium. In the X-axis direction, the distance between the first moving tray 60A and the straight line CL and the distance between the second moving tray 60B and the straight line CL are always the same.

The closed status of the lower support tray 60 means that the interval between the first moving tray 60A and the second moving tray 60B in the X-axis direction becomes an interval configured to support the medium bundle Pt as illustrated in FIG. 4A. Further, the opened status of the lower support tray 60 means that, as illustrated in FIG. 4B, the distance between the first moving tray 60A and the second moving tray 60B in the X-axis direction becomes an interval configured to drop the medium bundle Pt onto the main tray 33 without supporting it.

The medium bundle Pt discharged from the process tray 42 by the discharge roller pair 65 is temporarily supported by the lower support tray 60 in a closed state as illustrated in FIG. 4A. Then, as shown in FIG. 4B, when the lower support tray 60 opens, the medium bundle Pt supported by the lower support tray 60 falls onto the main tray 33. When the medium bundle Pt drops onto the main tray 33, the lower support tray 60 closes as shown in FIG. 4C. When the lower support tray 60 closes, the main tray 33 moves downward to support the next medium bundle Pt.

By providing such a lower support tray 60, it is possible to improve the stacking state of the medium bundle Pt on the main tray 33.

The main tray 33 is an example of a stacking section for stacking the medium bundle Pt falling due to the opening of the lower support tray 60. The main tray 33 is driven by a motor (not shown) in the stacking direction, that is, in the Z-axis direction.

Next, a problem when stacking the medium bundle Pt on the main tray 33 will be described. As shown in FIGS. 2 and 3, an end section 60*c* of the lower support tray 60 in the −A direction is located below an end section 42*b* of the process tray 42 in the +A direction. That is, a step is provided between the process tray 42 and the lower support tray 60. This makes it easy for the medium bundle Pt to move to the lower support tray 60 when the medium bundle Pt is discharged from the process tray 42 to the lower support tray 60.

Hereinafter, a description will be given with reference to FIGS. 5A to 5D. FIGS. 5A to 5D schematically show the medium discharge device 40 shown in FIGS. 2 and 3, and a part of the structure thereof is omitted.

Figure 5A:
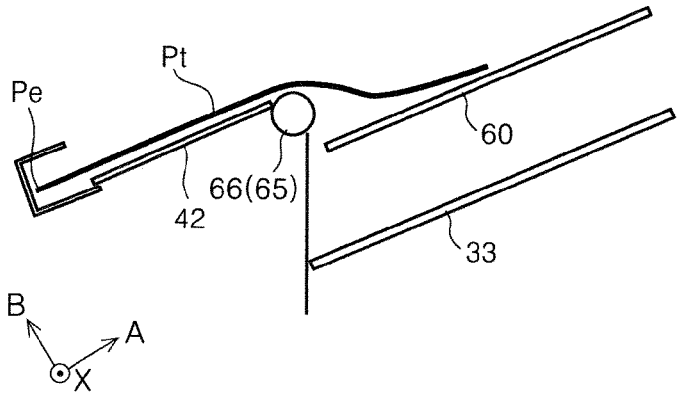
FIGS. 5A, 5B, 5C, and 5D are diagrams illustrating problems occurring when a medium bundle is discharged from a processing tray.
Figure 5B:
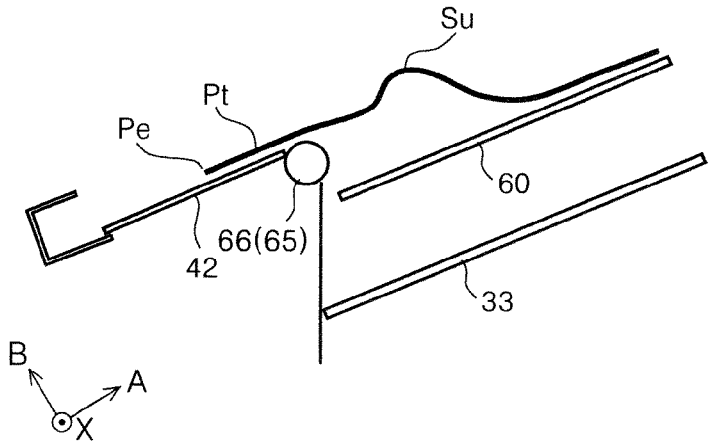
Figure 5C:
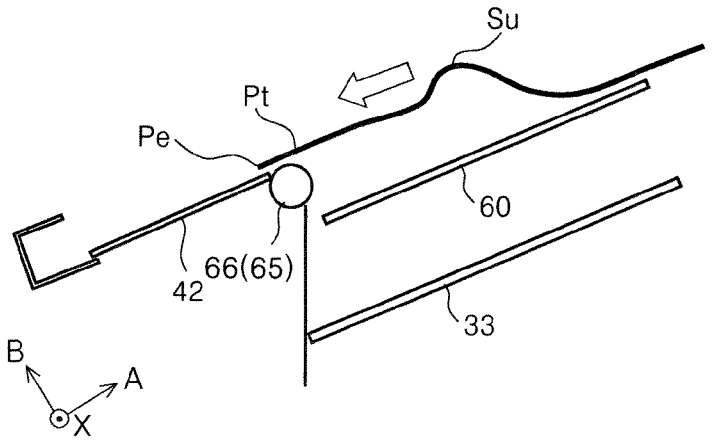
Figure 5D:
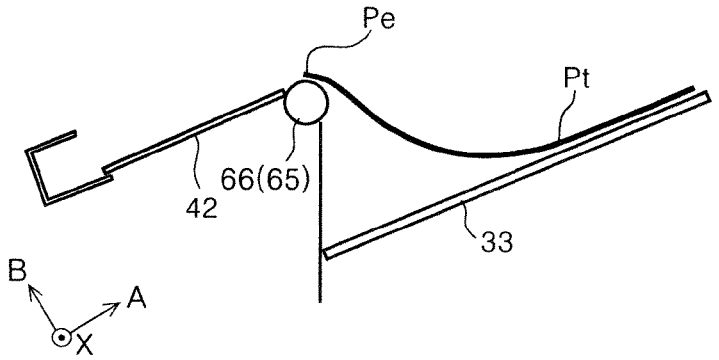

In a state in which the medium bundle Pt is supported by the process tray 42, when the discharge direction length is, as shown in FIG. 5A, a length protruding from the process tray 42 in the +A direction, then as shown in FIG. 5B, a deflection Su occurs at the time of discharge due to a step difference between the process tray 42 and the lower support tray 60. Then, during a period from when the medium bundle Pt is discharged to the lower support tray 60 to when the lower support tray 60 opens, as shown in FIG. 5C the rear edge Pe of the medium bundle Pt tends to return in the −A direction, that is, upstream in the discharge direction, by the action to eliminate the deflection Su, and as a result, the rear edge Pe remains on the discharge drive roller 66 as shown in FIG. 5D, and there is a risk that the medium bundle Pt does not appropriately drop to the main tray 33 even when the lower support tray 60 opens.

In order to suppress the occurrence of the problems described above, the medium discharge device 40 according to the present embodiment includes a curve imparting section 50. Although the operation and effect of the curve imparting section 50 described below and the curve imparting sections according to other embodiments will be described on the assumption that a medium bundle Pt is discharged, the same operation and effect can be obtained even when a single medium P is discharged.

Figure 6:
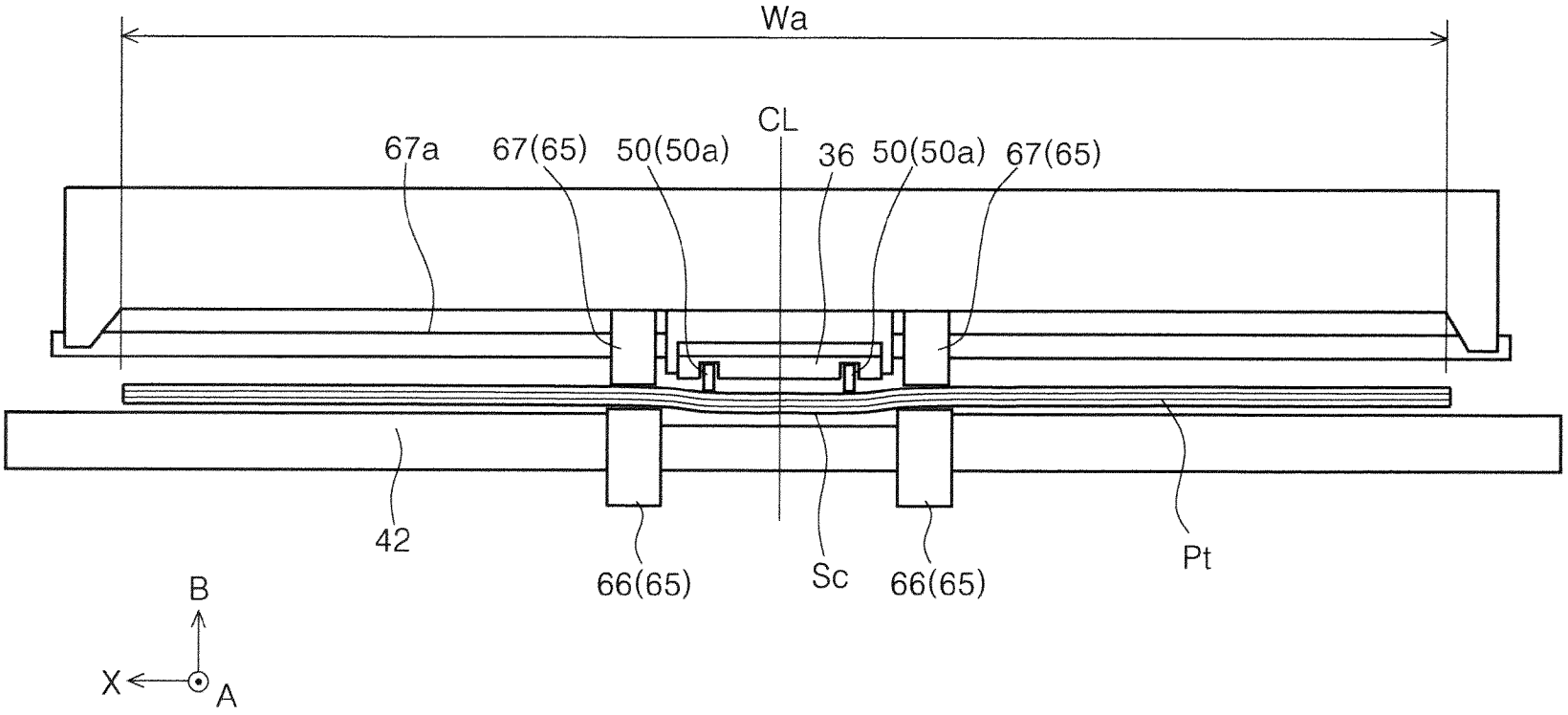
FIG. 6 is a view of a curve imparting section viewed from a discharge direction, and it shows a state in which a curve is applied to the medium bundle.
Figure 7:
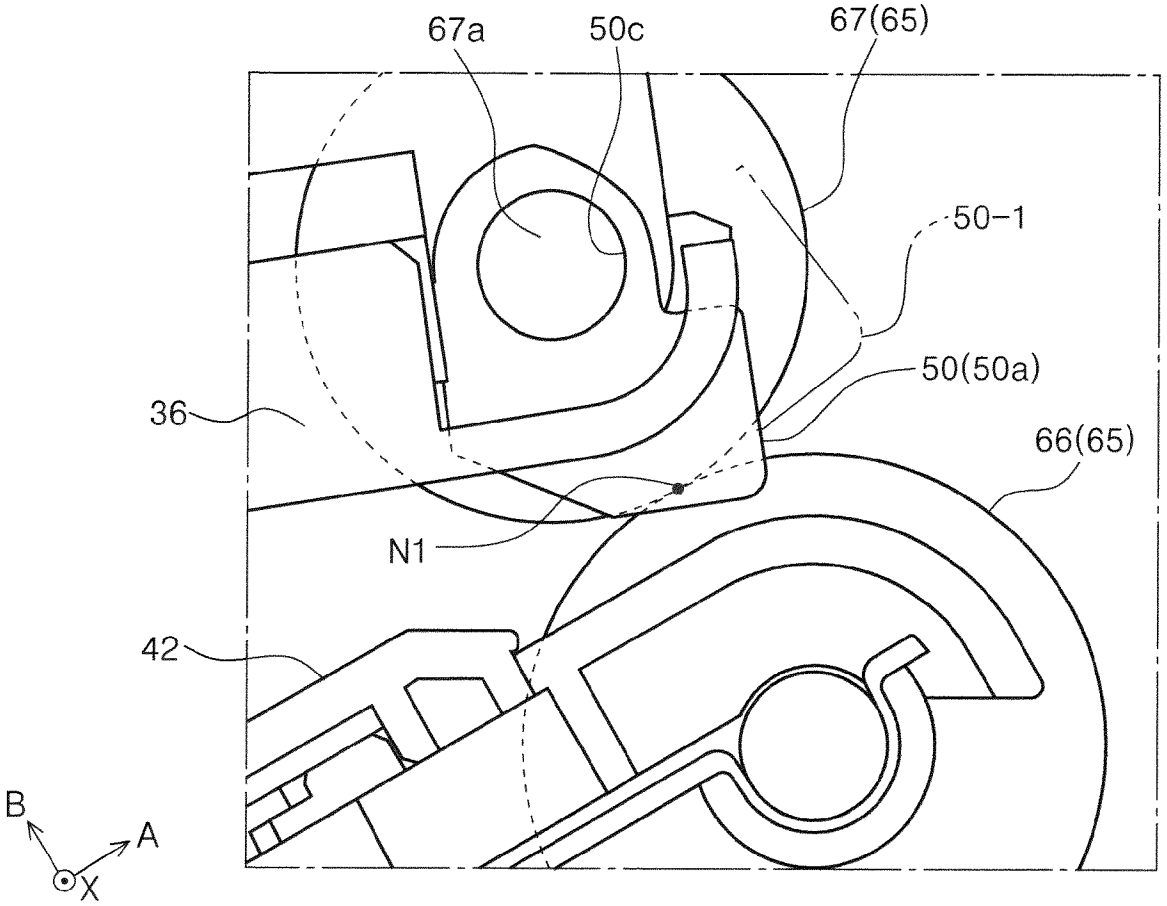
FIG. 7 is an enlarged side view of the curve imparting section.

In the present embodiment, as shown in FIGS. 3 and 7, the curve imparting section 50 is provided at a position overlapping with the discharge roller pair 65 as viewed in the X-axis direction, that is, the medium width direction, and as shown in FIG. 6 imparts a curve to the medium bundle Pt along the medium width direction by contacting the medium bundle Pt discharged by the discharge roller pair 65. That is, the curve imparting section 50 imparts, to the medium bundle Pt, a curve that warps in the medium width direction.

The curve formed in the medium bundle Pt in the present embodiment is a curve that is recessed downward at the straight line CL (center position). The curve formed in the medium bundle Pt is formed by the position where the discharge driven roller 67 contacts the upper surface of the medium bundle Pt and the position where the curve imparting section 50 contacts the upper surface of the medium bundle Pt being different in the B-axis direction.

By forming a curve in the medium bundle Pt in this way, it is possible to increase the rigidity in the discharge direction of the medium bundle Pt, and thereby it is possible to suppress the deflection Su described with reference to FIGS. 5B and 5C, and it is possible to appropriately drop the medium bundle Pt onto the main tray 33. As a result, it is possible to suppress a decrease in the degree of alignment of the medium bundle Pt on the main tray 33. If it is possible to suppress the deterioration in the degree of alignment of the medium bundle Pt on the main tray 33, it is also possible to suppress the occurrence of damage to the medium bundle Pt due to the deterioration in the degree of alignment.

In FIG. 6, a region Wa is a medium discharge region in the X-axis direction. Regardless of the size in the X-axis direction, that is, the width direction, the medium bundle Pt is curved downward in the center region.

In the present embodiment, the curve imparting section 50 is configured to come into contact with the medium bundle Pt from above the medium bundle Pt supported by the process tray 42. As a result, the curve imparting section 50 acts so as to press the medium bundle Pt against the discharge drive roller 66, so that the discharge action of the medium bundle Pt by the discharge drive roller 66 can be enhanced and the medium bundle Pt can be appropriately discharged.

In contrast to this embodiment, if the discharge drive roller 66 is provided above the discharge driven roller 67, the curve imparting section 50 may be configured to contact the medium bundle Pt from below the medium bundle Pt supported by the process tray 42.

Further, the curve imparting section 50 may be configured to press the medium bundle Pt against the discharge driven roller 67.

In the present embodiment, as shown in FIG. 7, the curve imparting section 50 extends downstream (in the +A direction) from the nip position N1 of the discharge roller pair 65 in the discharge direction, and can contact the medium bundle Pt downstream from the nip position N1.

Accordingly, the discharge operation of the medium bundle Pt by the discharge drive roller 66 can be obtained for a longer period of time, and the medium bundle Pt can be more appropriately discharged.

Note that as long as the curve imparting section 50 is capable of imparting a curve that warps in the medium width direction to the medium bundle Pt, then the downstream end of the position where the curve imparting section 50 contacts the medium bundle Pt may be located at the nip position N1 or upstream of the nip position N1.

In the present embodiment, the curve imparting section 50 is formed of a rib 50*b*. As a result, the curve imparting section 50 can be realized with a simple configuration.

In the present embodiment, a rib 50*a* is provided by using the shaft 67*a* of the discharge driven roller 67. As shown in FIG. 7, a shaft insertion hole 50*c* is formed in the rib 50*a*, the shaft 67*a* is passed through the shaft insertion hole 50*c*, and an abutting section (not shown) in the rib 50*a* is brought into contact with the guide member 36, whereby the rib 50*a* is fixed so as not to rotate with respect to the shaft 67*a*.

Since the rib 50*a* is provided by using the shaft 67*a* of the discharge driven roller 67 in this manner, it is not necessary to newly add a member for providing the rib 50*a*, and an increase in cost can be suppressed, and the positional accuracy of the rib 50*a* with respect to the discharge roller pair 65 can be improved by attaching the rib 50*a* to a position close to the discharge roller pair 65.

Further, in the present embodiment, as shown in FIG. 6, discharge roller pairs 65 are provided on both sides across the center position (straight line CL) of the medium bundle Pt in the medium width direction, and the curve imparting section 50 is provided to the inside of the discharge roller pairs 65 provided on both sides across the center position (straight line CL) of the medium bundle Pt in the medium width direction. Accordingly, the curve imparting section 50 can reliably apply the curve that warps in the width direction to the medium bundle Pt.

Figure 8:
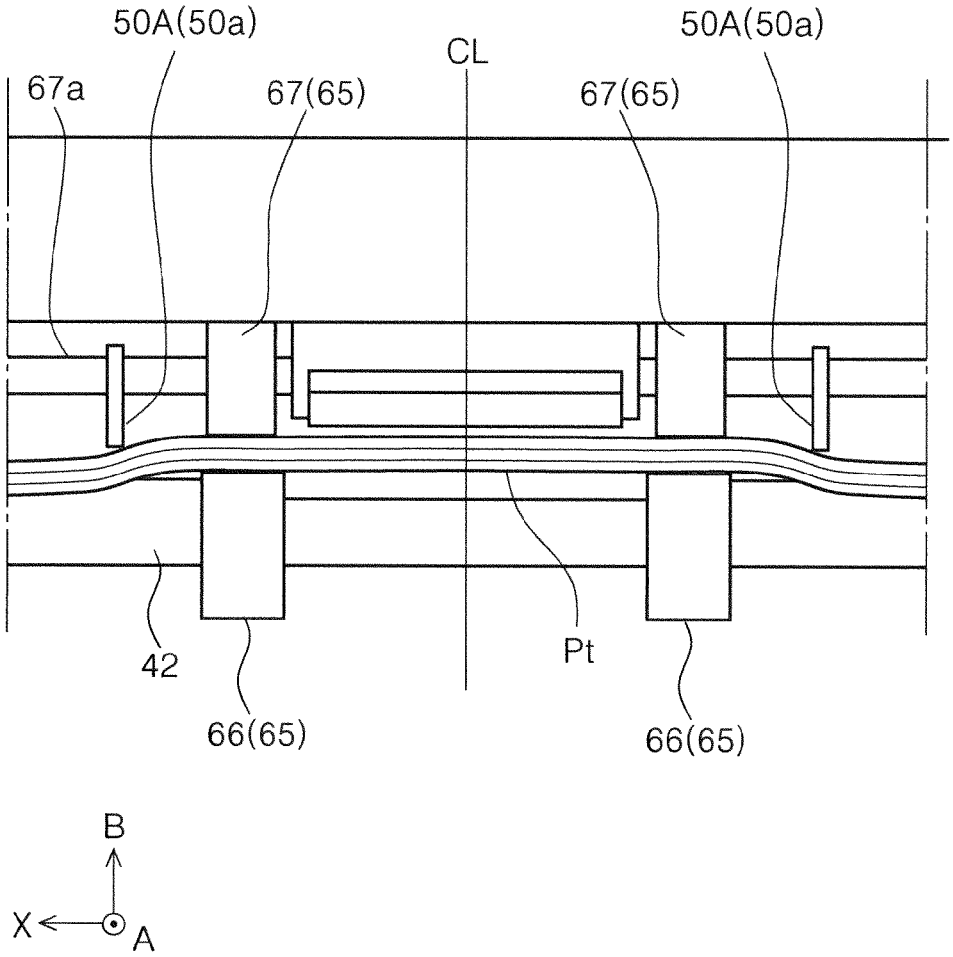
FIG. 8 is a view of the curve imparting section according to another embodiment as viewed from the discharge direction.

However, like a curve imparting section 50A shown in FIG. 8, a curve imparting section may be provided to the outside of the discharge roller pair 65.

In the present embodiment, the curve imparting section 50 is formed by two ribs 50*b* provided at intervals in the medium width direction, but may be formed by, for example, a single rib 50*b* or three or more ribs 50*b*.

Figure 9:
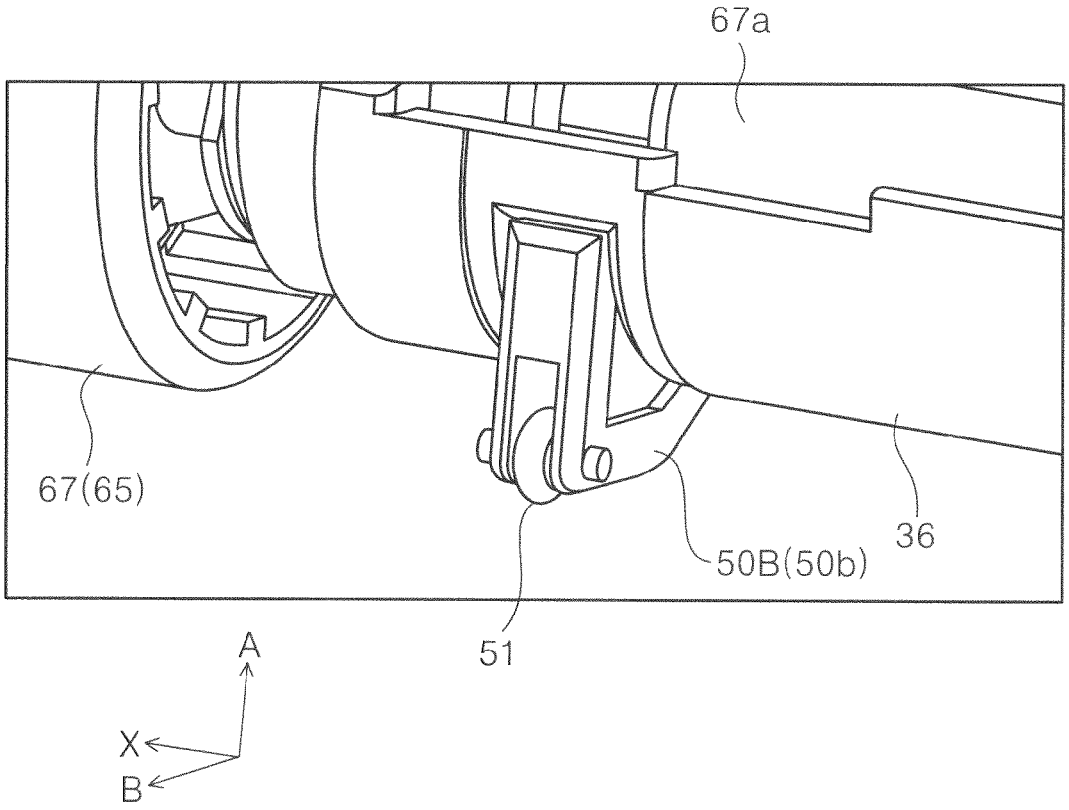
FIG. 9 is a perspective view showing a curve imparting section according to another embodiment.

Further, as shown in FIG. 9, the rib may be provided with a driven rotation section 51 that rotates in contact with the medium bundle Pt. In FIG. 9, a reference numeral 50B denotes a curve imparting section, and the curve imparting section 50B is formed of the rib 50*b*. The driven rotation section 51 that rotates in contact with the medium bundle Pt is provided on the rib 50*b*. Accordingly, it is possible to suppress the frictional force between the rib 50*b* and the medium bundle Pt and to smoothly discharge the medium bundle Pt.

Figure 10:
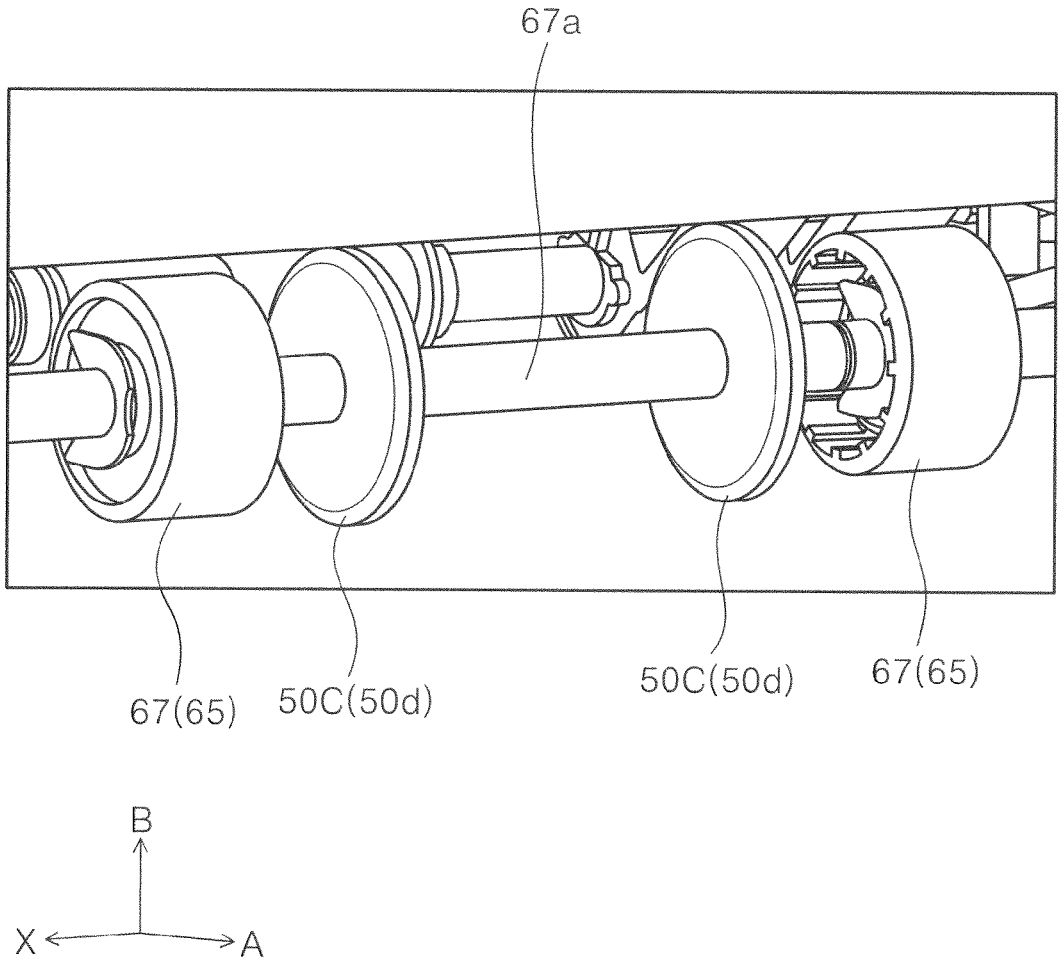
FIG. 10 is a perspective view showing a curve imparting section according to another embodiment.

The curve imparting section 50 may be formed from something other than a rib, as long as it can impart the curve that warps in the medium width direction to the medium bundle Pt. For example, a curve imparting section 50C, shown in FIG. 10, is composed of a rotating body 50*d* that rotates coaxially with the discharge driven roller 67. Also with such a configuration, the frictional force between the curve imparting section 50C and the medium bundle Pt is suppressed, and the medium bundle Pt can be smoothly discharged.

At this time, the rotating body 50*d* may rotate integrally with the discharge driven roller 67 or may rotate independently of the discharge driven roller 67.

In addition, since the curve imparting section 50 is provided in the movable unit 43 as illustrated in FIGS. 2 and 3, the curve imparting section 50 can be displaced between a contact position (FIG. 3), in which the curve imparting section 50 can contact the medium bundle Pt, and a separated position (FIG. 2), in which the curve imparting section 50 does not contact the medium bundle Pt. When the discharge roller pair 65 discharges the medium bundle Pt, in other words, when the discharge driven roller 67 advances toward the discharge drive roller 66, the discharge roller pair 65 is located at the contact position (FIG. 3), and when the discharge roller pair 65 does not discharge the medium bundle Pt, in other words, when the discharge driven roller 67 retreats from the discharge drive roller 66, the discharge roller pair 65 is located at the separation position (FIG. 2). Therefore, it is possible to suppress the curve imparting section 50 from coming into contact with the medium P in a state in which the discharge roller pair 65 is not discharging the medium bundle Pt. As a result, it is possible to suppress the medium P from being caught by the curve imparting section 50 when the medium P is sent to the process tray 42 or when the medium P is aligned on the process tray 42.

Further, the curve imparting section 50 is provided so as to engage with the guide member 36, and when the guide member 36 is in the retracted state (solid line in FIG. 2), the curve imparting section 50 is in the first state (solid line in FIG. 2). Also, when the guide member 36 is in the guide state (36-2 in FIG. 2), the curve imparting section 50 is in a second state (50-1 in FIG. 2) in which the curve imparting section 50 is retracted further from the process tray 42 than when in the first state. Accordingly, it is possible to further prevent the medium P from being caught by the curve imparting section 50 when the medium P is aligned on the process tray 42.

As indicated by two dot chain line and a reference numeral 43-1 in FIG. 2, the movable unit 43 can largely retract from the process tray 42 by rotating about a rotation shaft (not illustrated), and thus a user can remove the medium P jammed in the process tray 42. Reference numerals 36-1 and 50-2 denote the guide member and the curve imparting section, respectively, when the movable unit 43 is largely retracted from the process tray 42.

Here, a passageway member 59 configuring an upper portion of the medium discharge path is provided at a position facing the curve imparting section 50, and there is a concern that the curve imparting section 50 and the passageway member 59 interfere with each other when the movable unit 43 is retracted from the process tray 42.

Figure 11:
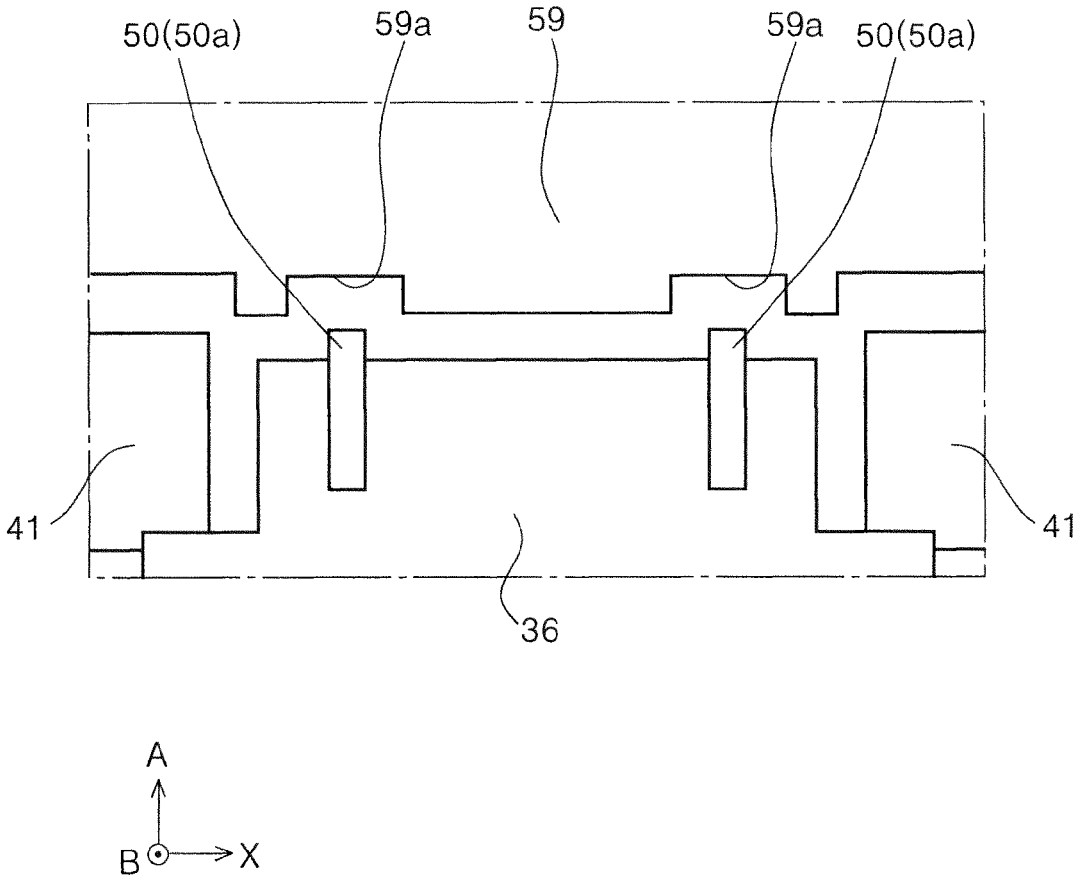
FIG. 11 is a view showing a recess portion which is a portion avoiding the curve imparting section.

However, as shown in FIGS. 2 and 11, the passageway member 59 is formed with a recess 59*a*, which is a portion for avoiding interference with the curve imparting section 50, so the movable unit 43 can be appropriately retracted from the process tray 42. In the present embodiment, the recess 59*a* for avoiding interference with the curve imparting section 50 is formed in the passageway member 59. However, when there is a possibility that the guide member 36 interferes with the passageway member 59, a portion for avoiding interference with the guide member 36 may be provided in the passageway member 59.

The present disclosure is not limited to the embodiments described above, and various modifications are possible within the scope of the disclosure described in the claims, and it goes without saying that such modifications are also included within the scope of the present disclosure.

What is claimed is:

1. A medium discharge device comprising:

an intermediate tray having an alignment section that aligns a rear end of a medium and on which the medium aligned by the alignment section is placed;

a pair of medium support sections that face each other in a width direction intersecting with a discharge direction of a medium discharged from the intermediate tray, are configured to support a front end, with respect to the discharge direction, of the medium placed on the intermediate tray, and are configured to be openable and closable by moving in opposite directions from each other in the width direction;

a discharge section configured to discharge the medium from the intermediate tray to the medium support section;

a stacking section provided below the pair of medium support sections and on which the medium dropped from the pair of medium support sections is stacked; and a curve imparting section that by contacting the medium discharged by the discharge unit, applies a curve to the medium, wherein an upstream end of the pair of medium support sections in the discharge direction is provided lower than a downstream end of the intermediate tray in the discharge direction, the curve imparting section imparts, to the medium, a curve that warps in the medium width direction, the curve imparting section is configured to displace between a contact position where the curve imparting section can contact the medium and a separated position where the curve imparting section does not contact the medium, when the discharge section discharges the medium, the curve imparting section is located at the contact position, and when the discharge portion does not discharge the medium, the discharge portion is positioned at the separation position.

2. The medium discharge device, according to claim 1, wherein the discharge section has a discharge roller pair that nips and discharges the medium, the discharge roller pair includes a driven roller configured to contact the medium from above the medium supported by the intermediate tray and a drive roller configured to contact the medium from below the medium supported by the intermediate tray, and the curve imparting section is configured to contact the medium from above the medium supported by the intermediate tray.

3. The medium discharge device, according to claim 2, wherein the curve imparting section is configured to contact the medium downstream in the discharge direction from a nip position of the discharge roller pair.

4. The medium discharge device, according to claim 2, wherein the curve imparting section is configured by a rib.

5. The medium discharge device, according to claim 4, wherein the rib includes, at a position in contact with the medium, a driven rotation section configured to rotate in contact with the medium.

6. The medium discharge device, according to claim 4, wherein the rib is provided by utilizing the shaft of the driven roller.

7. The medium discharge device, according to claim 2, wherein discharge roller pairs are provided on both sides across the center position of the medium in the width direction, and the curve imparting section is provided to the inside of the discharge roller pairs provided on both sides across the center position in the width direction.

8. A medium processing device comprising:

the medium discharge device, according to claim 1, and a processing section configured to perform a process on a medium placed on the intermediate tray.

9. A recording system comprising:

a recording device having a recording unit configured to perform recording on a medium and the medium processing device, according to claim 8, wherein the post process is performed on a medium recorded on by the recording device.

10. The recording system, according to claim 9, wherein the recording section performs recording by ejecting liquid onto a medium.

11. A medium discharge device comprising:

an intermediate tray having an alignment section that aligns a rear end of a medium and on which the medium aligned by the alignment section is placed;

a pair of medium support sections that face each other in a width direction intersecting with a discharge direction of a medium discharged from the intermediate tray, are configured to support a front end, with respect to the discharge direction, of the medium placed on the intermediate tray, and are configured to be openable and closable by moving in opposite directions from each other in the width direction;

a discharge section configured to discharge the medium from the intermediate tray to the medium support section;

a stacking section provided below the pair of medium support sections and on which the medium dropped from the pair of medium support sections is stacked; and a curve imparting section that by contacting the medium discharged by the discharge unit, applies a curve to the medium, wherein an upstream end of the pair of medium support sections in the discharge direction is provided lower than a downstream end of the intermediate tray in the discharge direction, the curve imparting section imparts, to the medium, a curve that warps in the medium width direction, the discharge section has a discharge roller pair that nips and discharges the medium, the discharge roller pair includes a driven roller configured to contact the medium from above the medium supported by the intermediate tray and a drive roller configured to contact the medium from below the medium supported by the intermediate tray, the curve imparting section is configured to contact the medium from above the medium supported by the intermediate tray, and the curve imparting section is configured by a rotating body that rotates coaxially with the driven roller.

12. A medium discharge device comprising:

an intermediate tray having an alignment section that aligns a rear end of a medium and on which the medium aligned by the alignment section is placed;

a pair of medium support sections that face each other in a width direction intersecting with a discharge direction of a medium discharged from the intermediate tray, are configured to support a front end, with respect to the discharge direction, of the medium placed on the intermediate tray, and are configured to be openable and closable by moving in opposite directions from each other in the width direction;

a discharge section configured to discharge the medium from the intermediate tray to the medium support section;

a stacking section provided below the pair of medium support sections and on which the medium dropped from the pair of medium support sections is stacked;

a guide member configured to switch between a guide state for guiding the medium to the alignment unit and a retracted state farther away from the intermediate tray than in the guide state; and a curve imparting section that by contacting the medium discharged by the discharge unit, applies a curve to the medium, wherein an upstream end of the pair of medium support sections in the discharge direction is provided lower than a downstream end of the intermediate tray in the discharge direction, the curve imparting section imparts, to the medium, a curve that warps in the medium width direction, the curve imparting section is provided so as to engage with the guide member, when the guide member is in the retracted state, the curve imparting section is in a first state, and when the guide member is in the guide state, the curve imparting section is in a second state in which the curve imparting section is more retracted from the intermediate tray than in the first state.

13. The medium discharge device, according to claim 12, further comprising:

a passageway member that forms a discharge path at the time when a medium is discharged from the intermediate tray to the pair of medium support sections, wherein the guide member and the curve imparting section are provided to be integrally advanceable and retractable with respect to the intermediate tray and the passageway member includes a portion for avoiding interference with the guide member and the curve imparting section when the guide member and the curve imparting section advance and retract with respect to the intermediate tray.

* * * * *